United States Patent [19]

Eneman

[11] 4,159,679

[45] Jul. 3, 1979

[54] PROJECTILE FUZE

[75] Inventor: Melvin Eneman, New York, N.Y.

[73] Assignee: The United States of America as represented by the Secretary of the Army, Washington, D.C.

[21] Appl. No.: 828,684

[22] Filed: Aug. 29, 1977

Related U.S. Application Data

[63] Continuation-in-part of Ser. No. 703,711, Jul. 9, 1976, abandoned.

[51] Int. Cl.[2] ..... F42C 15/22; F42C 1/00

[52] U.S. Cl. ..... 102/237; 102/273

[58] Field of Search ..... 102/79, 80, 73 A, 74, 102/73 R

[56] References Cited

U.S. PATENT DOCUMENTS

| | | | |
|---|---|---|---|
| 2,167,197 | 7/1939 | Brandt | 102/79 |
| 2,856,855 | 10/1958 | Horowitz | 102/79 |
| 3,033,115 | 5/1962 | Guerne | 102/79 X |
| 3,118,379 | 1/1964 | Jasse | 102/79 |
| 3,353,489 | 11/1967 | Berger | 102/79 |
| 3,616,757 | 11/1971 | Berger | 102/79 |
| 3,882,782 | 5/1975 | Simmon | 102/79 |
| 3,961,578 | 6/1976 | Popovitch | 102/74 X |

*Primary Examiner*—David H. Brown

*Attorney, Agent, or Firm*—Nathan Edelberg; Harold H. Card, Jr.; A. Victor Erkkila

[57] ABSTRACT

A low cost graze sensor fuze arrangement for a point detonating spin stabilized projectile in which firing pin actuation for detonation purposes is accomplished where the projectile may only graze the target and a graze sensor element will be laterally moved a limited amount to cam a firing pin assembly rearwardly toward a rotor armed detonator.

5 Claims, 2 Drawing Figures

PROJECTILE FUZE

The invention described herein may be manufactured, used and licensed by or for the Government for governmental purposes without the payment to me of any royalty thereon.

This is a continuation-in-part application of pending prior application Ser. No. 703,711 filed on July 9, 1976, now abandoned.

This invention relates to projectile fuzes, and to fuze arrangements for a point detonating spin stabilized projectile. More particularly, the invention relates to a novel arrangement of parts in a projectile fuze for moving a firing pin forward during the flight of the projectile, and for moving the firing pin rearwardly upon hitting or grazing a target. The present invention is particularly, though not exclusively, useful in fuzes of the type wherein the forward movement of a firing pin causes an explosive, such as a prime charge or detonator, for example, to move into a position for detonation upon the subsequent rearward motion of the firing pin, as, for example, in U.S. Pat. Nos. 3,118,379, 3,616,757, and 3,882,782; and these patents are incorporated herein by reference.

It is an object of the invention to provide an improved graze sensor fuze arrangement for a point detonating spin stabilized projectile.

Another object of the invention is to provide such an arrangement having means for precluding potential malfunctioning of the projectile fuze due to any undesirable lateral forces received during launch.

A further object of the invention is to provide such an arrangement having a minimum of cost and parts, as well as a minimum of critical tolerance requirements.

Figure 2:
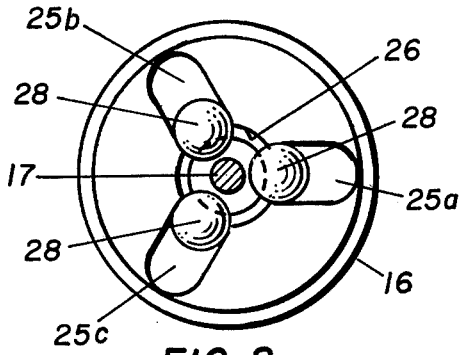
Figure 1:
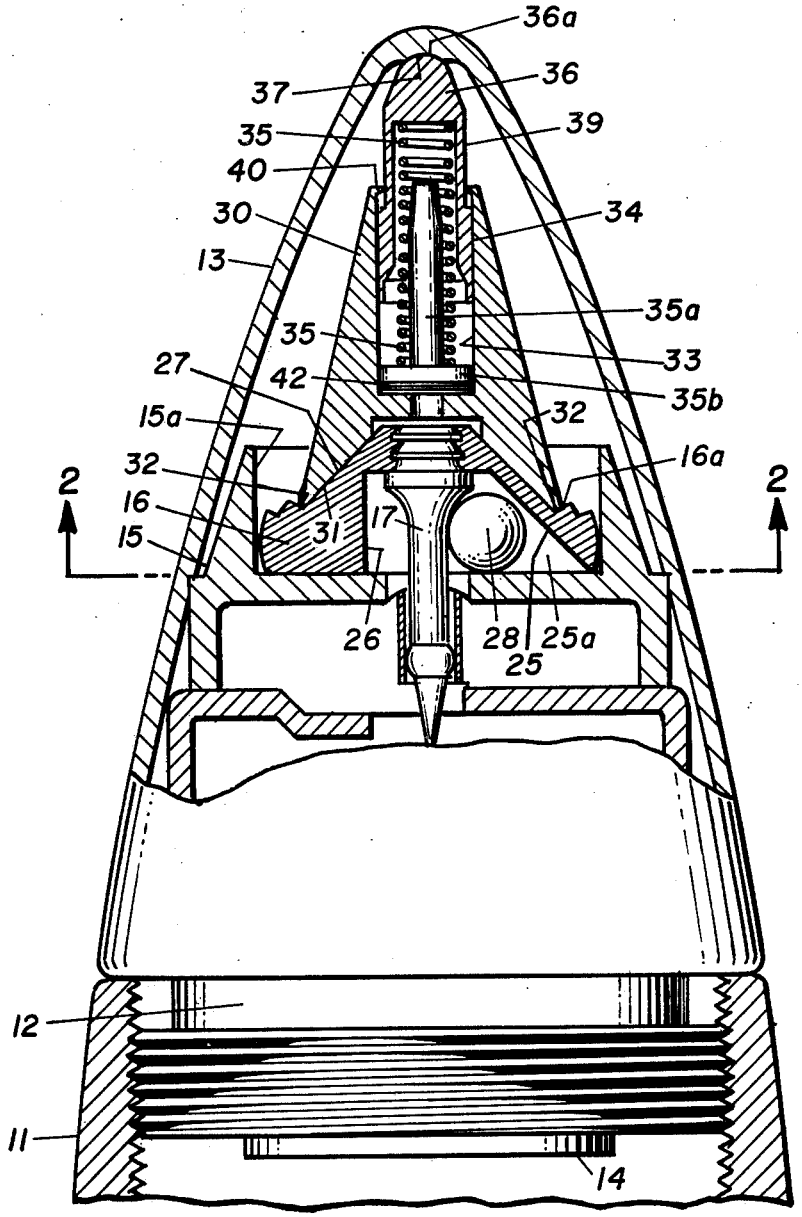

These and other objects, features and advantages will become more apparent from the following description and accompanying drawing in which:

FIG. 1 is a partial sectional view of a preferred unarmed projectile fuze arrangement embodying the principles of the invention; and FIG. 2 is a cross-section view of an annular firing pin assembly of the fuze, taken along the line 2—2 in FIG. 1, and viewed in the direction of the arrows.

A point detonating spin stabilized projectile 11 has an internally threaded forward opening in which is secured the externally threaded portion of a fuze housing or body 12 that securely carries a forward nose member 13 and a centrally located explosive assembly 14. The explosive assembly 14 may be any explosive assembly of the type that causes the projectile 11 to go from a safe condition to an activated condition so that the explosive assembly may be detonated when the projectile 11 hits or grazes a target. The explosive assemblies of the aforementioned patents, incorporated herein by reference, are suitable for use in the novel projectile fuze. The internal surface of the substantially conically tapered nose member 13 is suitably recessed to facilitate a secure mounting of a fuze forward housing 15 therewithin. Fuze forward housing 15 has a forwardly opening recess in which an annular firing pin assembly element 16 is slidably mounted. The fuze forward housing 15 has a central longitudinal passage accommodating a longitudinally movable firing pin 17 that is secured to, and protrudes rearwardly from, element 16.

Firing pin assembly element 16 has a plurality (preferably 3) of equally spaced triangular shaped slots **25*a*, 25*b*, and 25*c*, as shown in FIG. 2, formed or provided in its rearmost surface and which intersect or communicate with the commonly adjacent rearwardly opening cylindrical recess 26 that houses the flared enlargement of firing pin 17. Each of the slots 25*a*, 25*b*, and 25*c*, preferably has a portion that is substantially parallel to corresponding portions of the conically tapered forward external surface portion 27 of annular element 16. Corresponding camming balls 28, one positioned in each of the triangular slots, as shown in FIG. 2, in response to projectile spin developed centrifugal force cooperatively cam the firing pin assembly 16 forward to arm firing pin 17** and a graze sensor arrangement hereinafter described.

A substantially frusto-conical graze sensor element 30 has a tapered rearwardly opening annular recess 31 overlying a substantial forward portion of conical surface 27, the rearmost portion of recess 31 terminating in a small flat annular surface 32, which preferably extends in a transverse plane as shown or may be chamfered or beveled at a small angle so as to be substantially normal to recess surface 31, to cooperatively define a camming surface in at least partial contact with conical surface 27 and having a multitude of potential camming portions. Firing pin assembly element 16 has an annular forwardly protruding beveled surface 16A adjacent its periphery that limits the amount of rocking or lateral motion that may be imparted to graze sensor 30. Graze sensor 30 has a forwardly opening cylindrical recess 33 in which is slidably mounted a rearwardly opening tubular sleeve 34 that contains an appropriate compression spring 35. The spring surrounds a guide post 35A having a head 35B overlaying a predetermined plurality of washers 42. The closed forward end 36 of sleeve 34 has a central substantially partial spherial convex external surface 36A of substantially the same radius of curvature as the mating central concave interior tip surface protion 37 of nose member 13 to permit limited lateral tipping, rocking or rolling motion of elements 34 and and 30 substantially around a center or central contact point on nose surface 37. Spring 35, being seated against both the sleeve closed end 36 and effectively the base of graze sensor recess 33, will bias and maintain sleeve contact with nose surface 37 except for a temporary period during setback as a result of projectile launch. Preferably, the sleeve stepped cylindrical sidewall has a reduced diameter portion 39 on which is slidably mounted annular inwardly directed protuberance guide means 40 of graze sensor element 30 as formed upon assembly.

Upon projectile launch, setback forces will cause sleeve 34 to further compress spring 35 and bottom or seat the rearwardly facing base of the sleeve recess against the forward face of guide post 35A, and thereby against the base of graze sensor recess 33. Upon reduction of setback forces as the projectile leaves the gun barrel, spring 35 will extend causing the sleeve 34 to move forward to again contact nose surface 37. In response to centrifugal force of the spinning launched projectile, outward movement of cam balls 28 against the slotted inclined surfaces 25 will forwardly move elements 16 and 30 until the forward face of guide post 35A is pressed against the recess base of spring sleeve 34. In this position the cam balls 28 are in proximity to, but do not reach contact with the cylindrical inner surface 15A of housing 15. The washers 42 are provided to limit the motion of the cam balls 28 and the elements 16 and 30 as described. The washers 42 provide an inexpensive means, suitable for assembly by automated machinery, to achieve the necessary functional relationship while using standard manufacturing tolerances for the pertinent fuze parts.

Should the nose tip make a direct target impact, elements 34, 30 and 16 will be thrust rearwardly and the firing pin 17 will strike the detonator of the armed rotor. However, should the projectile only graze impact the target, the resulting lateral force component will tip, rock or roll elements 34 and 30 a limited amount within the nose tip and cam element 16 rearwardly to thrust the firing pin into the detonator.

Various modifications, changes or alterations may be resorted to without departing from the scope of the invention as set forth in the claims.

I claim:

1. In a point detonating spin stabilized projectile having a tapered forward nose member and a fuze forward housing secured in said nose member, said fuze forward housing having a central longitudinal passage accommodating a longitudinally movable firing pin, said fuze forward housing having a forwardly opening recess containing a firing pin assembly, said firing pin assembly including said firing pin and an element having a plurality of slotted inclined walls, a camming ball adjacent each of said slotted inclined walls, each of said balls being responsive to centrifugal force for forwardly camming said firing pin assembly to arm said firing pin assembly, a graze sensor having means for rearwardly camming said armed firing pin assembly to operatively actuate said firing pin, said graze sensor having a forwardly opening cylindrical recess, said firing pin assembly element having means including an annular forwardly protruding beveled surface for limiting lateral movements of said graze sensor, a rearwardly opening tubular sleeve slidably mounted in said cylindrical recess, and a compression spring in said sleeve for forwardly biasing said sleeve against said nose member.

2. The structure in accordance with claim 1 wherein said sleeve has a stepped cylindrical sidewall defining a reduced diameter portion, and said graze sensor has an inwardly directed protuberance for guiding relative motion between said sleeve and graze sensor, said sleeve having a closed forward end terminating in a central convex external surface portion, said nose member having a central concave tip surface portion, said convex and concave surface portions having substantially the same radius of curvature.

3. The structure of claim 1 wherein a guide post having an enlarged head portion is positioned in said graze sensor cylindrical recess, said compression spring surrounds said guide post, and a plurality of washers are positioned intermediate said guide post head portion and the base of said graze sensor cylindrical recess.

4. The structure according to claim 1 wherein said firing pin assembly includes a conically tapered forward external surface portion, and said graze sensor has a tapered rearwardly opening recess having surface portions in at least partial contact with said conical surface portion and partially defining said camming means.

5. The structure of claim 4 wherein the rearmost portion of said graze sensor has a terminating tapered recess in a substantially flat annular surface for contacting a portion of said annular forwardly protruding beveled surface.

* * * * *